US007472819B1

(12) United States Patent
Wachter

(10) Patent No.: US 7,472,819 B1
(45) Date of Patent: Jan. 6, 2009

(54) SHIPPING AND DISPLAY CONTAINER AND ASSOCIATED CONTAINER BLANK

(75) Inventor: Richard G. Wachter, Batavia, IL (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 11/967,834

(22) Filed: Dec. 31, 2007

(51) Int. Cl.
*B65D 5/02* (2006.01)

(52) U.S. Cl. ..... 229/167; 229/164; 229/178; 229/180

(58) Field of Classification Search ..... 229/164, 229/178, 180, 167, 172, 185.1
See application file for complete search history.

(56) References Cited

U.S. PATENT DOCUMENTS 2,893,621 A * 7/1959 Harnish et al. ..... 229/178
2,925,211 A * 2/1960 Frankenstein ..... 229/178
3,102,674 A * 9/1963 Hamilton ..... 229/178
3,529,762 A * 9/1970 Johnson ..... 229/178
3,904,106 A * 9/1975 Elder ..... 229/178
3,973,723 A * 8/1976 Owens ..... 229/178
4,911,355 A * 3/1990 Bannister ..... 229/178
5,277,360 A * 1/1994 DeMott ..... 229/164
5,330,094 A * 7/1994 Mertz ..... 229/178
6,029,886 A * 2/2000 Sheffer ..... 229/178
6,098,873 A * 8/2000 Sheffer ..... 229/178
6,158,653 A * 12/2000 Kanter et al. ..... 229/185.1
6,874,679 B2 * 4/2005 Tibbles et al. ..... 229/185.1

* cited by examiner

*Primary Examiner*—Gary E Elkins

(57) ABSTRACT

The embodiments of the present invention provide a blank of foldable material configurable to form a container. When formed, the container includes a viewing section formed in a front panel. Likewise, the side panel and rear panel assemblies have both inner and outer panel configurations. The side panel assemblies include at least one intermediate partial side panel as well. The multi-panel side and rear panel assemblies give strength and stability to the container. The container may be partially machine erected, machine erected, or hand set.

5 Claims, 8 Drawing Sheets

SHIPPING AND DISPLAY CONTAINER AND ASSOCIATED CONTAINER BLANK

FIELD OF INVENTION

This invention relates generally to cellulose-based blanks and containers and more specifically to wood cellulose-based blanks and containers used for storing and displaying goods.

BRIEF DESCRIPTION OF THE DRAWINGS

Various embodiments of the present invention are described in detail below with reference to the following FIGURES.

DETAILED DESCRIPTION

The present invention provides a blank and resulting container for storing and displaying a variety of goods. By way of overview, and with reference to the FIGS. 1 through 8, various embodiments of the present invention include a single piece blank 20 of formable material arranged to form a container 60. Specific details of the blank 20 and container 60 are described in more particularity below.

Figure 1:
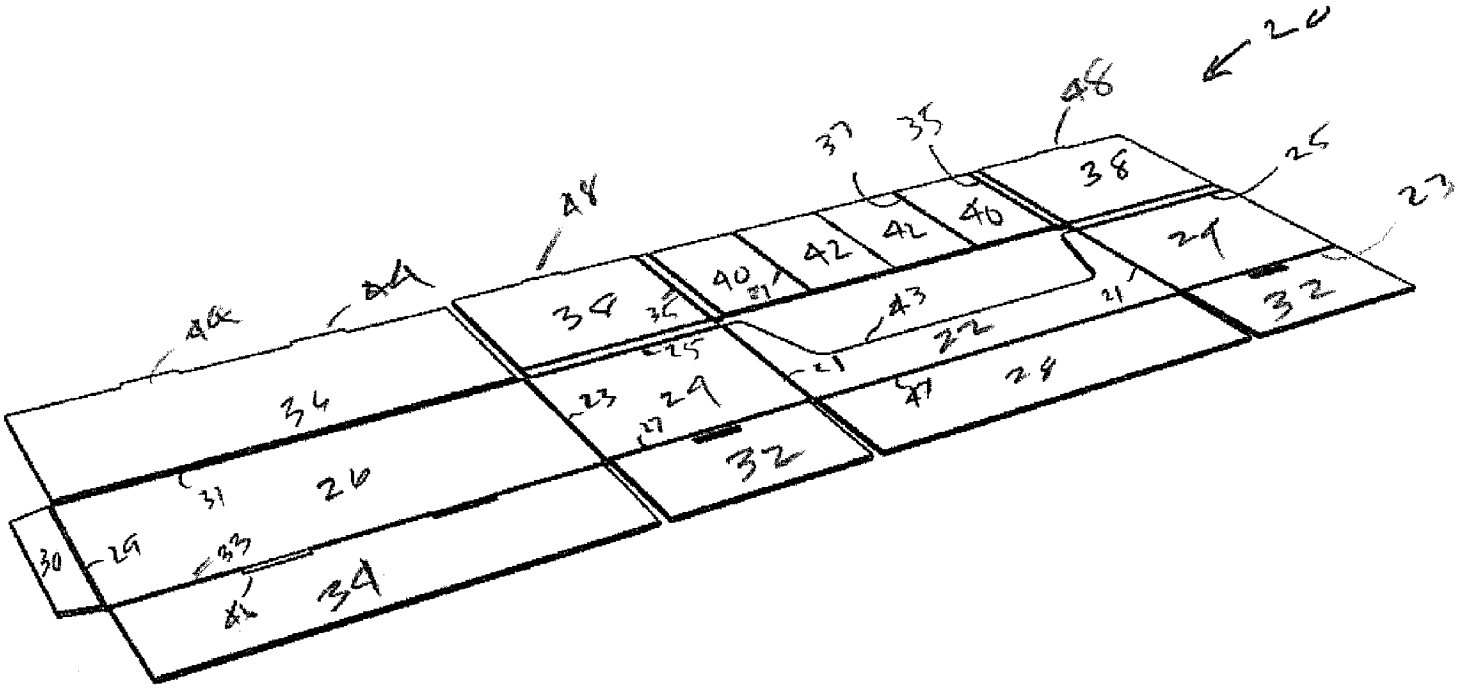
FIG. 1 is a plan view of a single piece container blank formed in accordance with an aspect of the present invention.

FIG. 1 depicts a blank 20 used to form container 60. The blank 20 is preferably constructed from a single piece of formable material such as, without limitation, sheets of cellulose-based materials formed from cellulose materials such as wood pulp, straw, cotton, bagasse or the like. Cellulose-based materials used in this present invention come in many forms such as fiberboard, containerboard, corrugated containerboard, and paperboard. The blank 20 is cut and scored, perforated or otherwise formed to include a plurality of panels that when assembled form container 60. In all FIGURES, like numbers indicate like parts. Additionally, cut lines are shown as solid lines, score lines as dashed lines, and lines of perforation as broken lines.

FIG. 1 depicts the blank 20 made in accordance with an aspect of the present invention. The blank 20 includes a front panel 22. Opposed fold lines 21, fold line 47 and cut line 43, bound the front panel 22. Cut line 43 provides a viewing section once the container 60 is fully erected. The front panel 22 is either typically square or rectangular with a cutout portion formed in an edge such that a viewing section is formed in the front panel 22. Connected with the front panel 22 along fold line 47 is a first outer bottom panel 28.

Connected with the front panel 22 along the opposed fold lines 21 are outer side panels 24. The outer side panels 24 are bounded by opposed fold lines 21 and 23, and opposed fold lines 25 and 27. Fold lines 25 are actually a pair of spaced apart fold lines that allow for fold over assembly with a relatively small panel positioned between spaced apart fold lines 25. Connected with the outer side panel 24 along the spaced apart fold lines 25 is an inner side panel 38. Further, connected with the outer side panel along fold line 27 is an inner bottom panel 32. Inner bottom panel 32 included inner bottom panel slot 50.

Connected with one of the outer side panels 24 along fold line 23 is an outer rear panel 26. Outer rear panel 26 is bounded by opposed fold lines 23 and 29 and opposed fold lines 31 and 33. Connected with the outer rear panel 26 along fold line 33 is a second outer bottom panel 34. The second outer bottom panel 34 includes second outer bottom panel slots 46. Connected with the outer rear panel 26 along fold line 31 is inner rear panel 36. The inner rear panel includes inner rear panel tabs 44. Connected with the outer rear panel 26 along fold line 29 is manufacture's joint panel 30.

Connected with the inner side panel 38 along another pair of spaced apart fold lines 35 is a first partial side panel 40. Connected with the first partial side panel 40 along a fold line 37 is a second partial side panel 42.

FIGS. 2-7 depict the erection of the blank 20 into container 60. Specifically, the blank 20 is folded over such that the manufacture's joint panel 30 is juxtaposed a portion of an outer side panel 24. Adhesives or mechanical fasteners such as, without limitation, staples, then join these respective panels together. It will be appreciated that this may be done on a conventional box folder/gluer or by hand. At this stage, the container 60 is in it's knocked down configuration.

Figure 2:
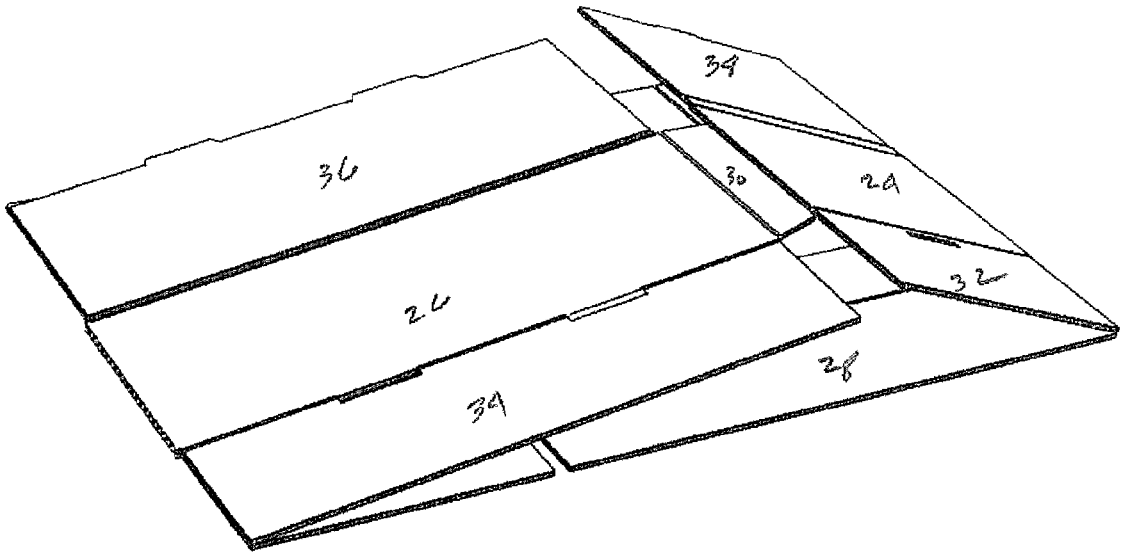
FIG. 2 is a perspective view of a partially assembled container assembled according to an aspect of the present invention.
Figure 3:
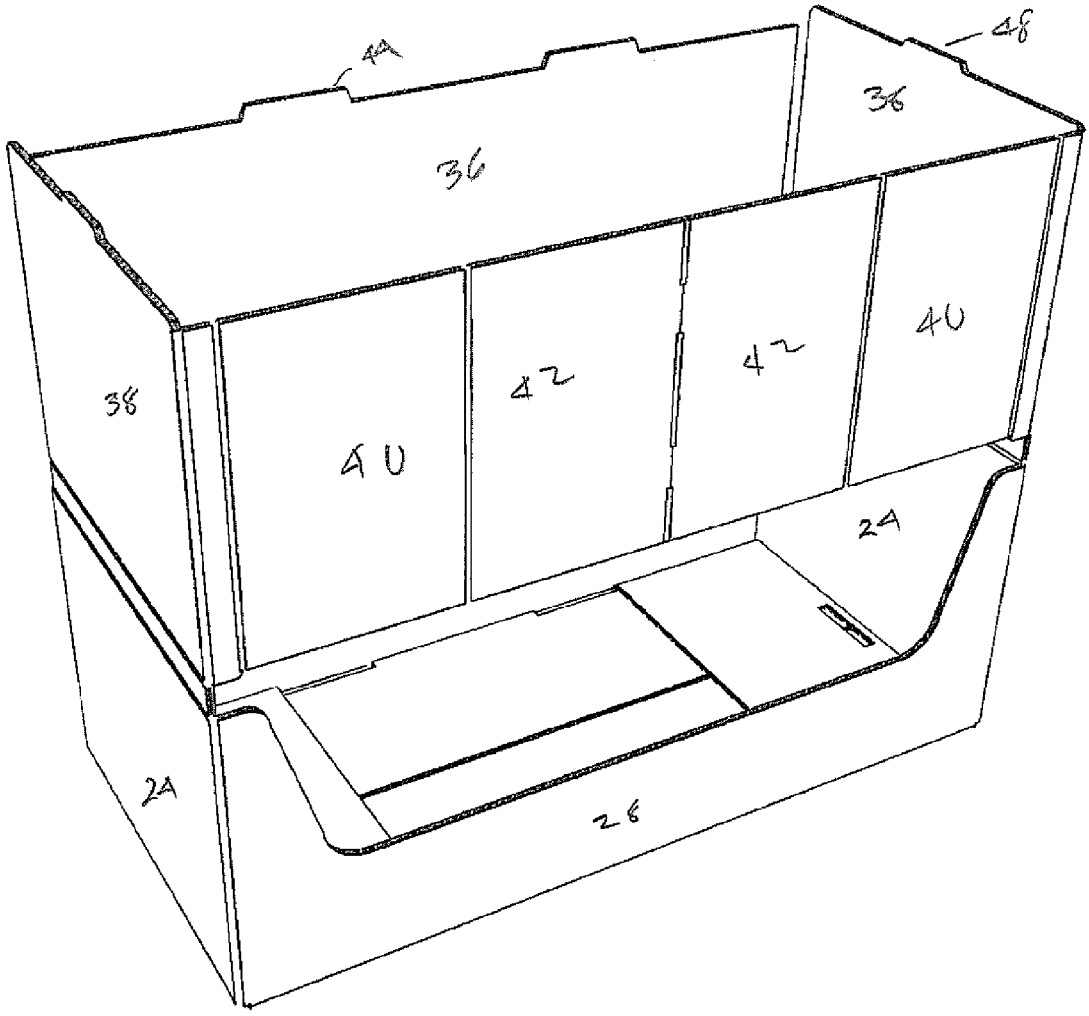
FIG. 3 is another perspective view of a partially assembled container assembled according to yet another aspect of the present invention.
Figure 4:
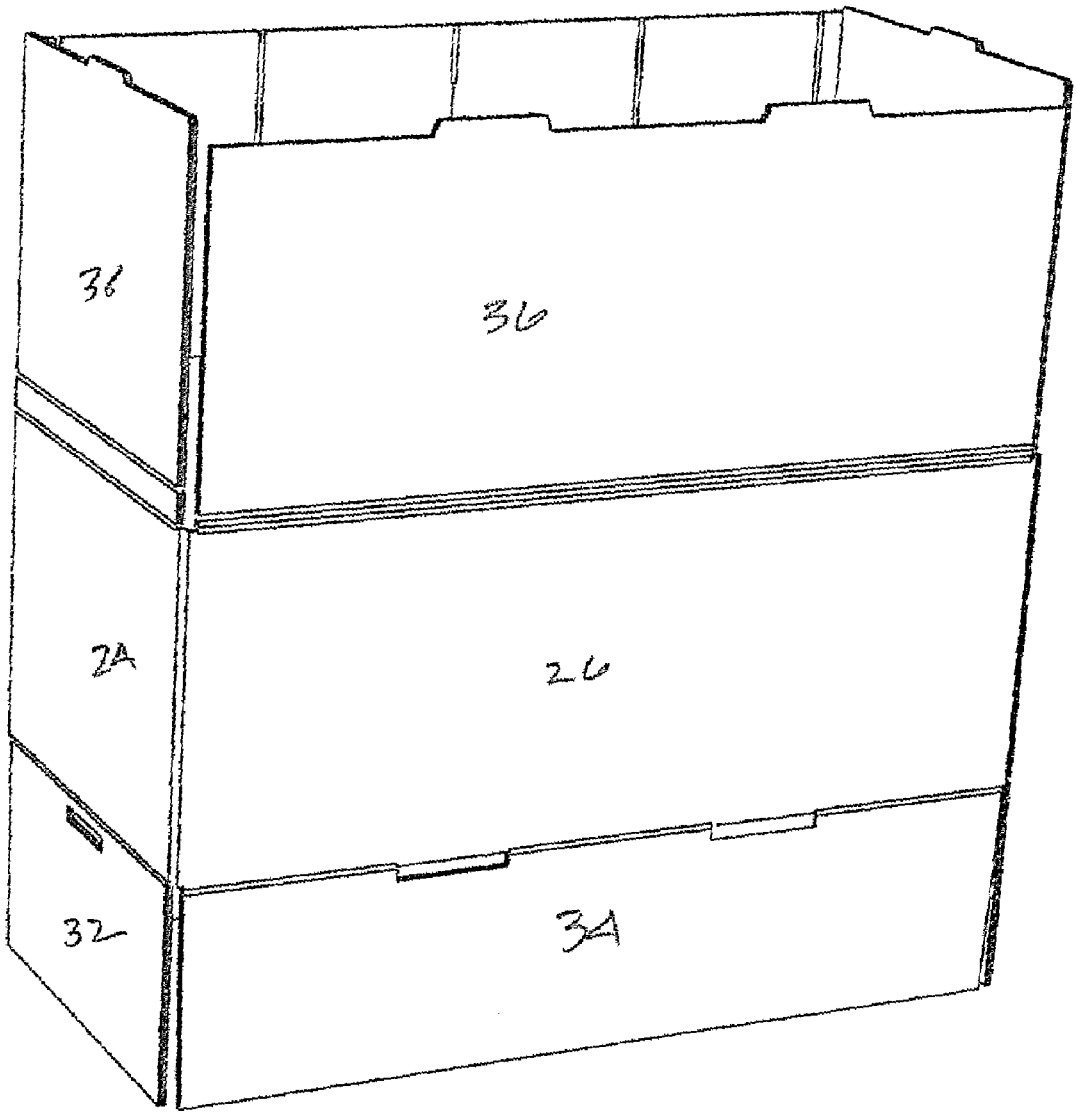
FIG. 4 is yet another perspective view of a partially assembled container assembled according to a further aspect of the present invention; and, FIG. 5 is a perspective view of a partially assembled container assembled according to an aspect of the present invention.
Figure 5:
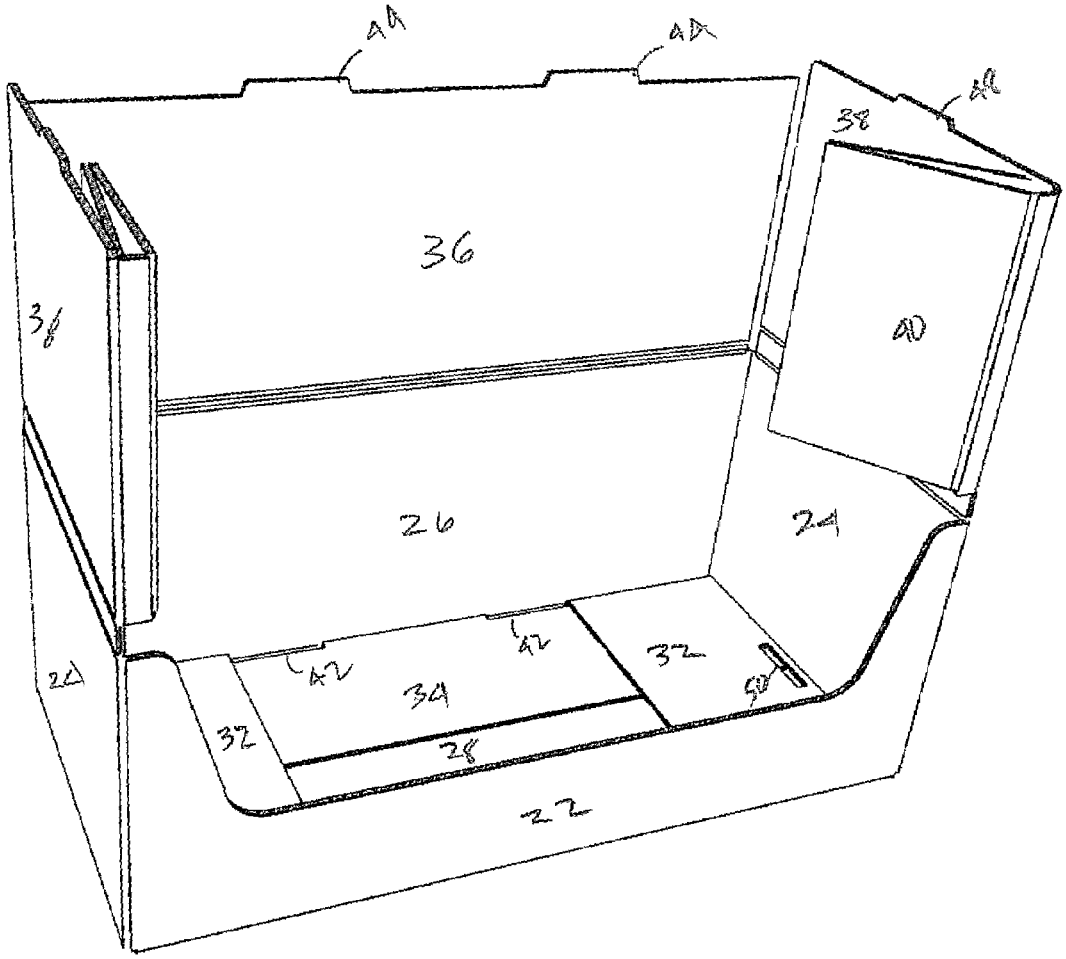
Figure 6:
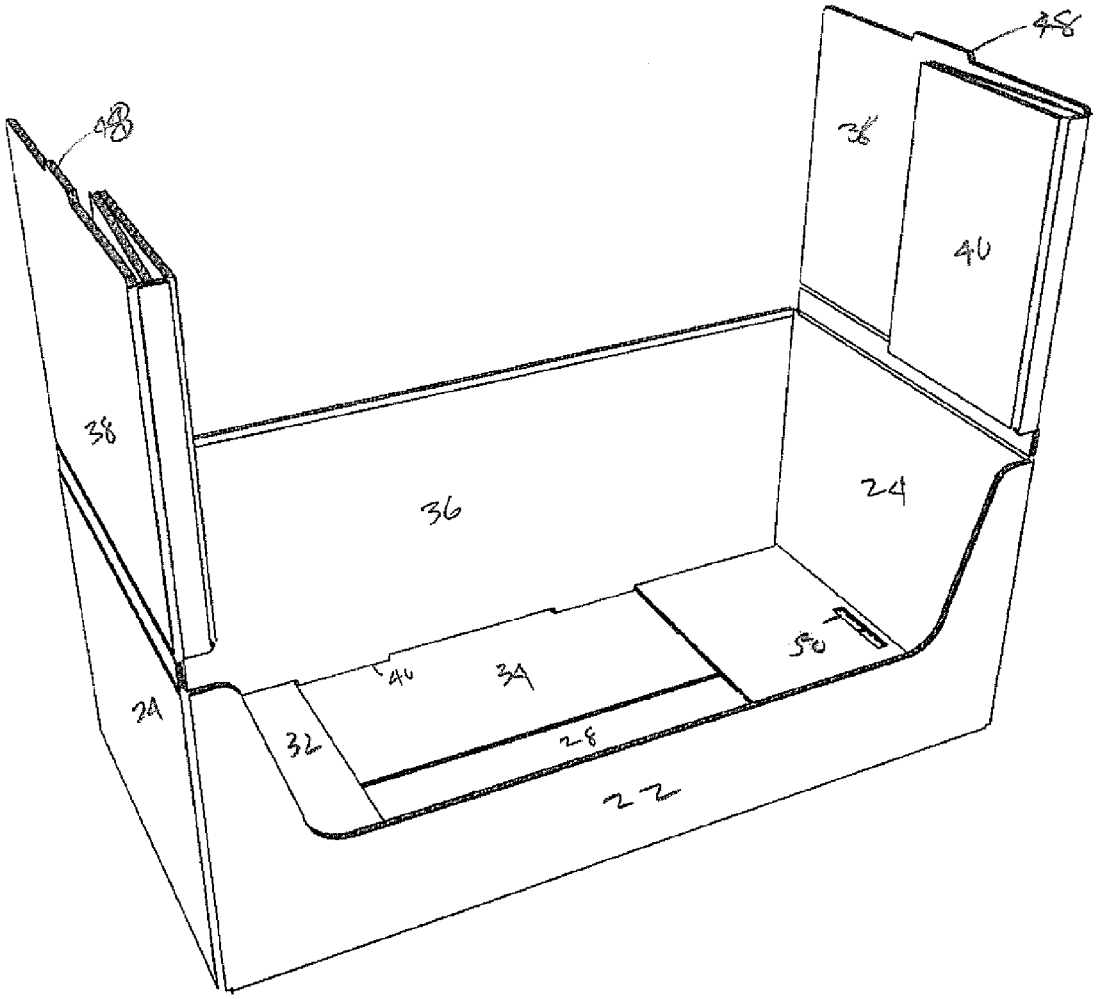
FIG. 6 is another perspective view of a partially assembled container assembled according to an aspect of the present invention.
Figure 7:
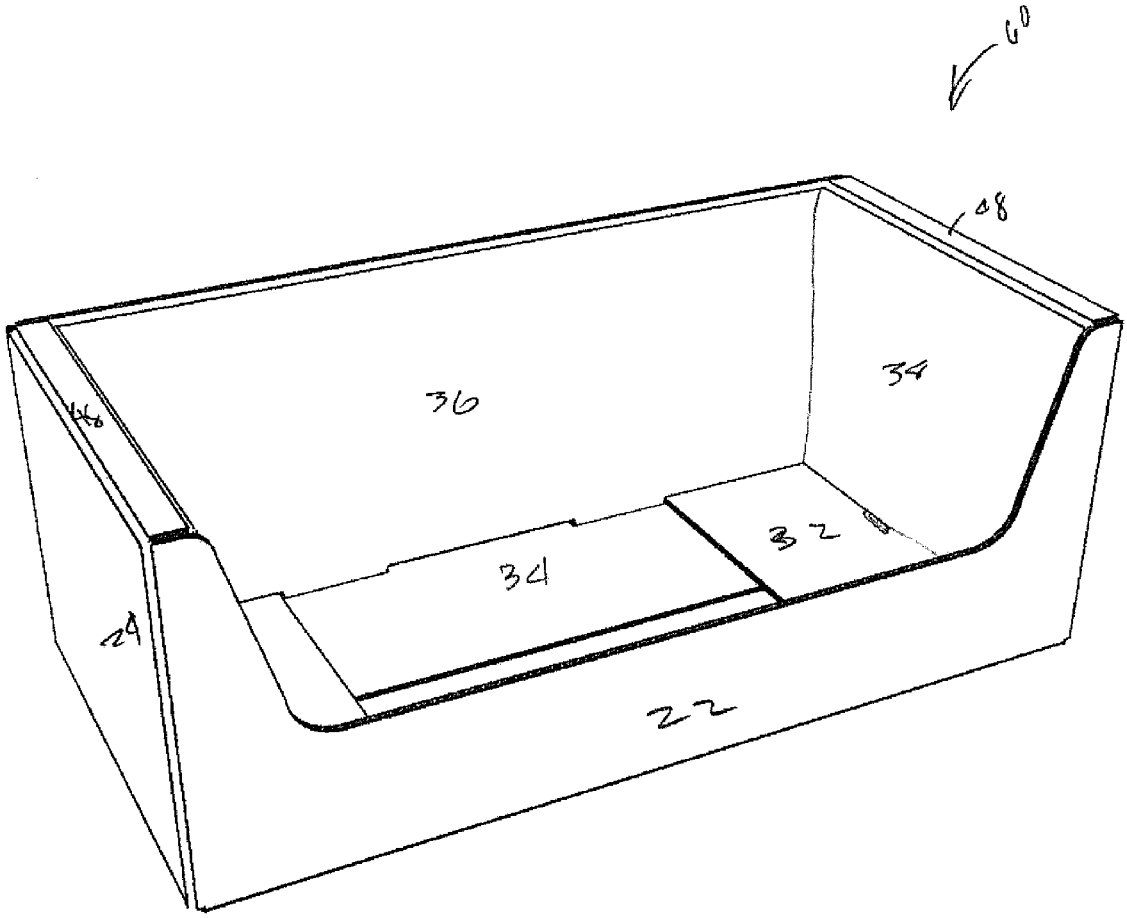
FIG. 7 is a perspective view of the assembled container blank of FIG. 1.

It will be appreciated that the blank 20 may be sent to a customer as a blank 20, partially formed, knocked down container, or a fully formed container 60. If space is not an issue, sending the blank 20 or container 60 to customer may be desired. However, where space is a premium, sending the container 60 in its knocked down form as depicted in FIG. 2 is available.

In any event, the container may be fully erected from the knocked down state by hand whenever desired. A general overview of the folding sequence to form the container 60 is illustrated in FIGS. 3-7. Those skilled in the art are capable of understanding the illustrated folding sequence as one possible sequence to reach the erect container 60, and as such, any specific sequence need not be discussed in detail to understand the invention.

As mentioned above, it will be appreciated that as these various panels may be held in place by any variety of fastening means known in the industry. Suitable, non limiting examples of such fasteners includes glue or other adhesive, tape, staples or combinations thereof. As fasteners are known in the industry, a detailed description is not necessary herein.

Figure 8:
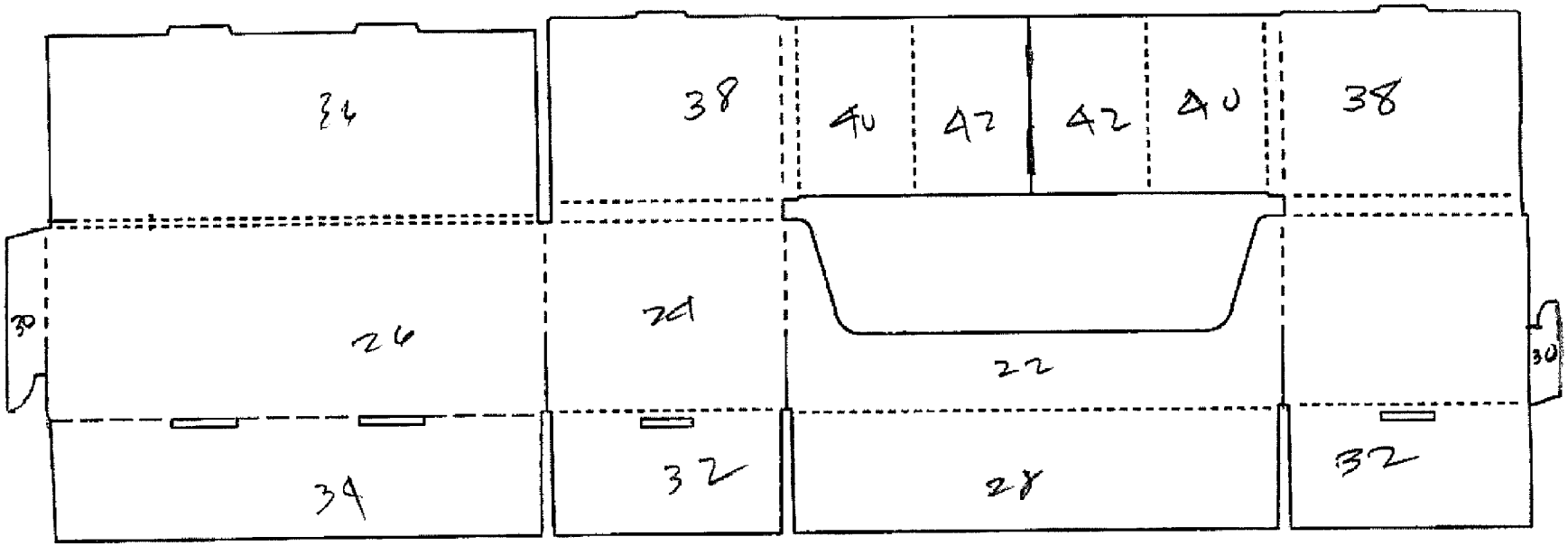
FIG. 8 is a plan view of another embodiment of a single piece container blank formed in accordance with another aspect of the present invention.

FIG. 8 depicts a blank 20 included an additional embodiment. Specifically, this version includes all the same features as disclosed above with the exception that a hand-set locking mechanism is used in place of the manufactures joint disclosed above. In this manner, then entire container 60 may be formed by hand. This version replaces the single manufacture's joint panel 30 with a pair of manufacture joint panels 30 configured with interlocking tab's and slots.

A variety of additional elements may be included, such as, without limitation, vents, specialized liners or grease barriers, etc., without departing from the spirit and scope of the present invention. Similarly, rounding or otherwise trimming of various panels is considered within the scope of this invention.

While various embodiments of this invention have been illustrated and described as noted above, many changes can be made without departing from the spirit and scope of this invention. Accordingly, the scope of the invention should be determined entirely by reference to the claims that follow.

What is claimed is:

1. A single sheet of foldable material cut and scored to define as container, the container comprising:

a front panel;

a pair of opposed outer side panels connected with the front panel, each of the outer side panels having an upper edge and opposed side edges;

an outer rear panel connected with one of the outer side panels along a side edge of the one outer side panel; said outer rear panel being substantially parallel to said front panel;

a pair of inner side panels, each inner side panel connected with the upper edge of its adjacent outer side panel via a pair of spaced apart fold lines, each inner side panel having opposed side edges;

a pair of first partial side panels, each first partial side panel juxtaposed a portion of its adjacent outer side panel, each first partial side panel having opposed side edges;

a pair of second partial side panels, each second partial side panel between its adjacent first partial side panel and its adjacent inner side panel, the second partial side panel having opposed side edges, wherein each inner side panel is connected with its adjacent first partial side panel via a pair of spaced apart fold lines along one of the side edges of the inner side panel, and wherein each second partial side panel is attached to its adjacent first partial side panel along the side edge of the adjacent first partial side panel opposite the attachment of the adjacent first partial side panel to the inner side panel, and wherein the combined width of the first partial side panels and second partial side panels is substantially equal to the width of the front panel.

2. The container of claim 1, wherein the single sheet of foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

5. A blank for a container comprising a sheet of material divided by transverse fold lines to define an outer back panel, a first outer side panel, a front panel, a second outer side panel, the sheet of material divided by a longitudinal fold line to define an inner back panel attached to the outer back panel, the sheet of material divided by a first pair of spaced apart longitudinal fold lines to define a first inner side panel attached to the first outer side panel, the sheet of material divided by a second pair of spaced apart longitudinal fold lines to define a second inner side panel attached to the second outer side panel, the first and second pair of spaced apart longitudinal fold lines being longitudinally aligned, the first and second inner side panels being longitudinally aligned, the first and second inner side panels each having opposed transverse side edges, one of the side edges of the first inner side panel facing one of the side edges of the second inner side panel, the first inner side panel having a first partial side panel attached thereto along the facing edge of the first inner side panel, the second inner side panel having a second first partial side panel attached thereto along the facing edge of the second inner side panel, the first partial side panel having a first second partial side panel attached thereto along the edge opposite the first inner side panel's facing edge, the second first partial side panel having a second partial side panel attached thereto along the edge opposite the second inner side panel's facing edge, the first and second partial side panels being transversely aligned with the front panel in the blank.

* * * * *